US007341066B2

(12) United States Patent
Oh et al.

(10) Patent No.: US 7,341,066 B2
(45) Date of Patent: Mar. 11, 2008

(54) WASHING MACHINE

(75) Inventors: Soo Young Oh, Seoul (KR); Kyung Chul Woo, Seoul (KR); Jin Woong Kim, Gyeonggi-Do (KR); Si Moon Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 581 days.

(21) Appl. No.: 10/757,990

(22) Filed: Jan. 16, 2004

(65) Prior Publication Data

US 2005/0034490 A1 Feb. 17, 2005

(30) Foreign Application Priority Data

Aug. 13, 2003 (KR) ..... 10-2003-0056224

(51) Int. Cl.
*D06F 37/00* (2006.01)
*D06F 3/00* (2006.01)
*D06F 27/00* (2006.01)

(52) U.S. Cl. ..... 134/5 C; 134/3 R; 134/147; 134/207

(58) Field of Classification Search ..... 68/5 R, 68/5 C, 7, 15, 222
See application file for complete search history.

(56) References Cited

U.S. PATENT DOCUMENTS

| | | | | |
|---|---|---|---|---|
| 1,999,446 A | | 4/1935 | Delano | |
| 3,129,361 A | | 4/1964 | Berenbaum | |
| 4,941,333 A | | 7/1990 | Blessing | |
| 5,461,887 A | * | 10/1995 | VonPless | 68/18 F |
| 6,434,857 B1 | | 8/2002 | Anderson et al. | |
| 2002/0117497 A1 | * | 8/2002 | Bassill et al. | 219/626 |
| 2004/0187529 A1 | | 9/2004 | Kim et al. | |

FOREIGN PATENT DOCUMENTS

| | | | |
|---|---|---|---|
| DE | 197 43 508 A1 | | 4/1999 |
| EP | 0 816 550 A1 | | 1/1998 |
| EP | 1 275 767 A1 | | 1/2003 |
| GB | 21286 | | 0/1898 |
| JP | 11-226290 | | 8/1999 |
| JP | 2000176192 A | * | 6/2000 |
| JP | 2002-83673 A | | 3/2002 |
| JP | 2002-106801 A | | 4/2002 |
| JP | 2003-019382 A | | 1/2003 |
| JP | 2003-21303 A | | 1/2003 |
| JP | 2003-093775 | | 4/2003 |

* cited by examiner

*Primary Examiner*—Michael Barr
*Assistant Examiner*—Rita R Patel
(74) *Attorney, Agent, or Firm*—Birch, Stewart, Kolasch & Birch, LLP

(57) ABSTRACT

A washing machine includes a tub disposed inside a cabinet, for storing water; a drum rotatably disposed inside the tub, for washing laundry; and a steam generating apparatus disposed at the cabinet, for generating steam supplied to the inside of the drum, by using high-frequency induction heating. Accordingly, by generating steam using high-frequency induction heating, a structure of the steam generating apparatus can be simplified, and performance of generating steam can be improved.

10 Claims, 3 Drawing Sheets

WASHING MACHINE

This Non-provisional application claims priority under 35 U.S.C. § 119(a) on patent application Ser. No(s). 10-2003-0056224 filed in Korea on Aug. 13, 2003, the entire contents of which are hereby incorporated by reference.

BACKGROUND OF THE INVENTION

1. Field of the Invention

The present invention relates to a washing machine, and more particularly, to a washing machine capable of heating laundry by spraying steam thereon.

2. Description of the Background Art

FIG. 1 is a sectional view of a drum washing machine according to the conventional art.

The conventional washing machine includes a cabinet 102 forming the exterior, a tub 104 positioned inside the cabinet 102 and storing water, a drum 106 rotatably disposed inside the tub 104 and performing washing and dewatering operation of the laundry, and a driving motor 110 connected to the drum 106 by a driving shaft 108 and rotating the drum 106.

The tub 104 is buff-supported by dampers 120 and 122 inside the cabinet 102, and a heater 130 for heating water stored in the tub 104 is installed at a lower side of the tub 104.

Herein, a sufficient space is to be secured for installing the heater 130 between the tub 104 and the drum 106, and the water level inside the tub 104 needs to be maintained by more than a predetermined amount so that the heater 130 can be sufficiently soaked in water.

The operation of the conventional drum washing machine will now be described.

When the washing machine is driven, water is supplied into the tub 104, and when the water level in the tub 104 reaches a pre-set level, the heater 130 is operated to heat water. And the driving motor 110 is moved forwardly and backwardly at the same time when the water is heated by the heater 130, thereby performing a washing operation. When the temperature of water reaches a pre-set temperature, the heater 130 is turn off.

However, the conventional washing machine has a problem that since a receiving space should be obtained at the lower side of the tub 104 in order to install the header 130 therein for heating the laundry, the overall size of the washing machine is increased, and in addition, since water is filled in the heater-received space, water is much wasted.

In addition, since water is heated by the header 130, a power consumption of the heater 130 is increased, use amount of detergent is increased, and washing time is lengthened.

SUMMARY OF THE INVENTION

Therefore, one object of the present invention is to provide a washing machine capable of reducing an overall size and the amount of water used for washing, minimizing power consumption, and shortening a washing time by heating the laundry by spraying stream directly to the laundry.

Another object of the present invention is to provide a washing machine capable of simplifying a structure of the steam generating apparatus and improving performance of generating steam by generating steam using high-frequency induction heating.

To achieve these and other advantages and in accordance with the purpose of the present invention, as embodied and broadly described herein, there is provided a washing machine including A washing machine comprising: a tub disposed inside a cabinet, for storing water; a drum rotatably disposed inside the tub, for washing laundry; and a steam generating apparatus disposed at the cabinet, for generating steam supplied to the inside of the drum, by using high-frequency induction heating.

The steam generating apparatus includes a housing having a water supply pipe through which water is supplied, and a steam discharge pipe through which steam is discharged; a coil disposed at an outer circumferential surface of the housing, for generating a high-frequency magnetic field; and a heating material disposed inside the housing to generate heat, for generating steam supplied into the housing, by the high-frequency magnetic field generated from the coil.

The steam discharge pipe of the housing is connected with a spray nozzle by a steam supply line so that the steam generated from the housing is sprayed into the drum through the spray nozzle.

A fan is installed at one side of the steam supply line, for increasing spray pressure of the spray nozzle.

The coil is wound on the outer circumferential surface of the housing, and is electrically connected with an inverter applied a high-frequency current.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
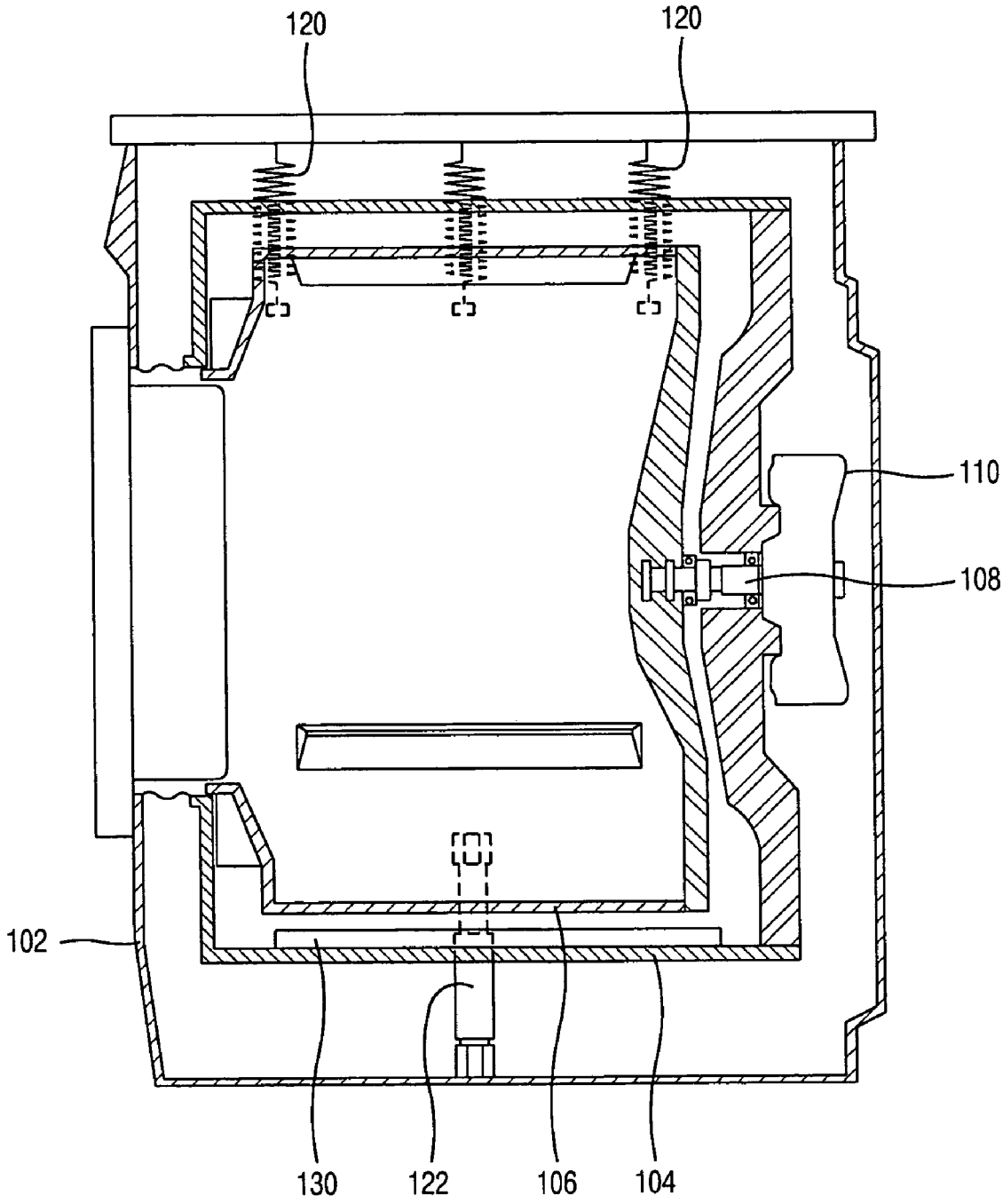
FIG. 1 CONVENTIONAL ART
FIG. 1 is a sectional view of a drum washing machine according to the conventional art.
Figure 2:
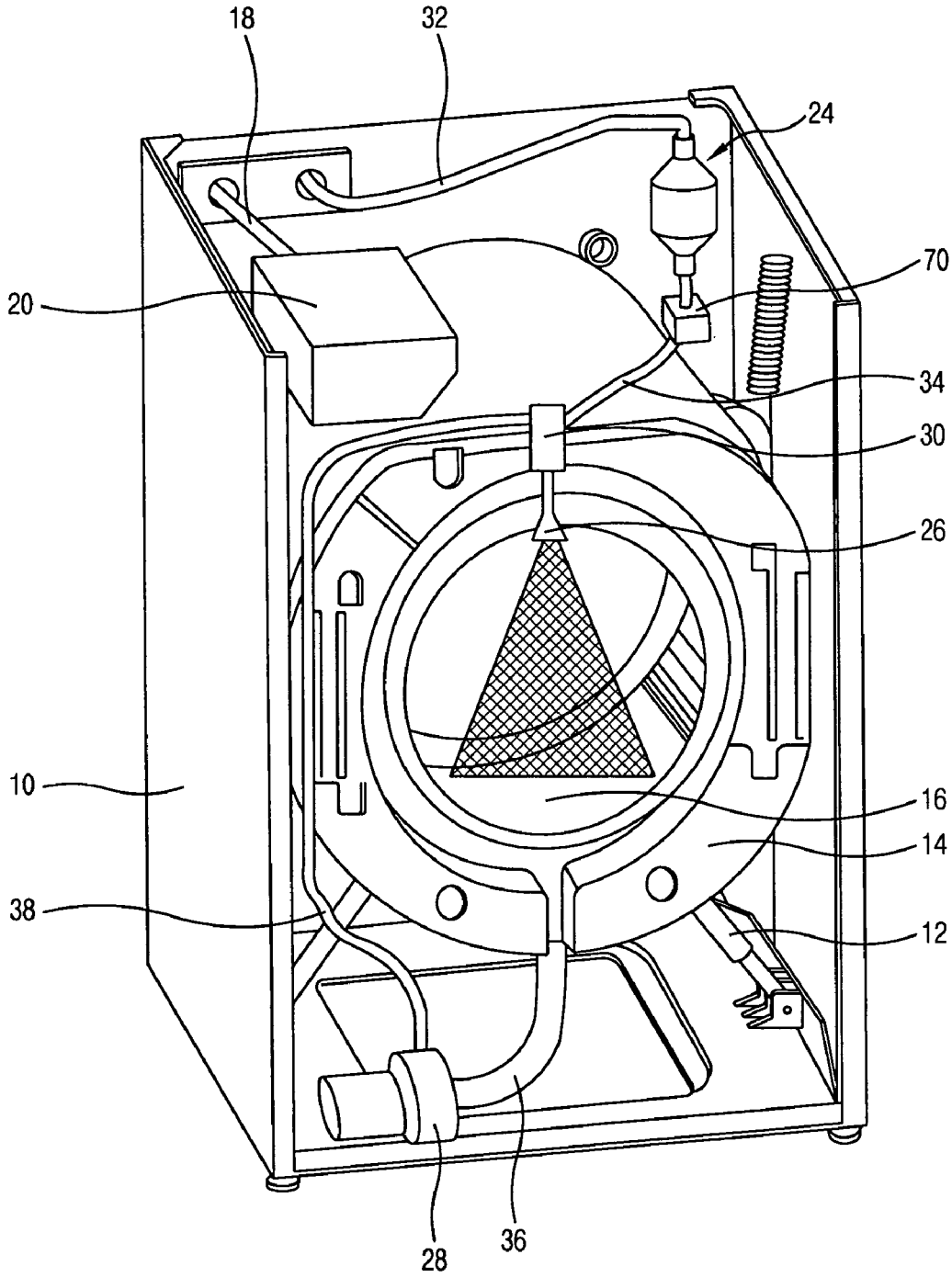
FIG. 2 is a perspective view showing a washing machine of which a front surface is opened according to the present invention.

FIG. 2 is a perspective view of a washing machine of which a front surface is opened according to one embodiment of the present invention.

A washing machine according to one embodiment of the present invention includes a cabinet 10 forming an exterior; a tub 14 shock-absorbingly supported by a damper at the cabinet 10, for storing washing water; a drum 16 rotatably disposed inside the tub 14, for washing and dewatering laundry; a steam generating apparatus 24 disposed at an upper portion of the cabinet 10, for generating steam; a circulation pump 28 disposed at the lower portion of the tub 14, and for pumping water discharged from the tub 14 to resupply the water into the tub 14; and a spray nozzle 26 for spraying one of steam generated at the steam generating apparatus 24 and water circulated by the circulation pump 28 into the drum 16.

A detergent box 20 connected to a water supply tube 18 is installed at an upper side of the outer tub 14 thus to supply detergent with washing water into the outer tub 14.

And, a dividing unit 30 is installed at the spray nozzle 26, for preventing flowing backward steam generated by the steam generating apparatus 24 and water pumped by pumping of the circulation pump 28.

The steam generating apparatus 24 is connected with the water supply line 32 to receive water from the outside, and is connected with the dividing unit 30 by a steam supply line 34. Herein, at one side of the water supply line 32, a water supply valve (not shown) for opening/closing the water supply line 32 is installed to supply water to the steam generating apparatus 24 or to cut off the water supply.

The circulation pump 28 is connected with a discharge pipe 36 through which water stored in the tub 14 is discharged, and is connected with the dividing unit 30 by a circulation line 38. Thus, the circulation pump 28 pumps water discharged from the discharge pipe 36 and supplies the water to the dividing unit 30 through the circulation line 38. And, the water supplied to the dividing unit 30 is sprayed into the drum 16 through the spray nozzle 26.

Figure 3:
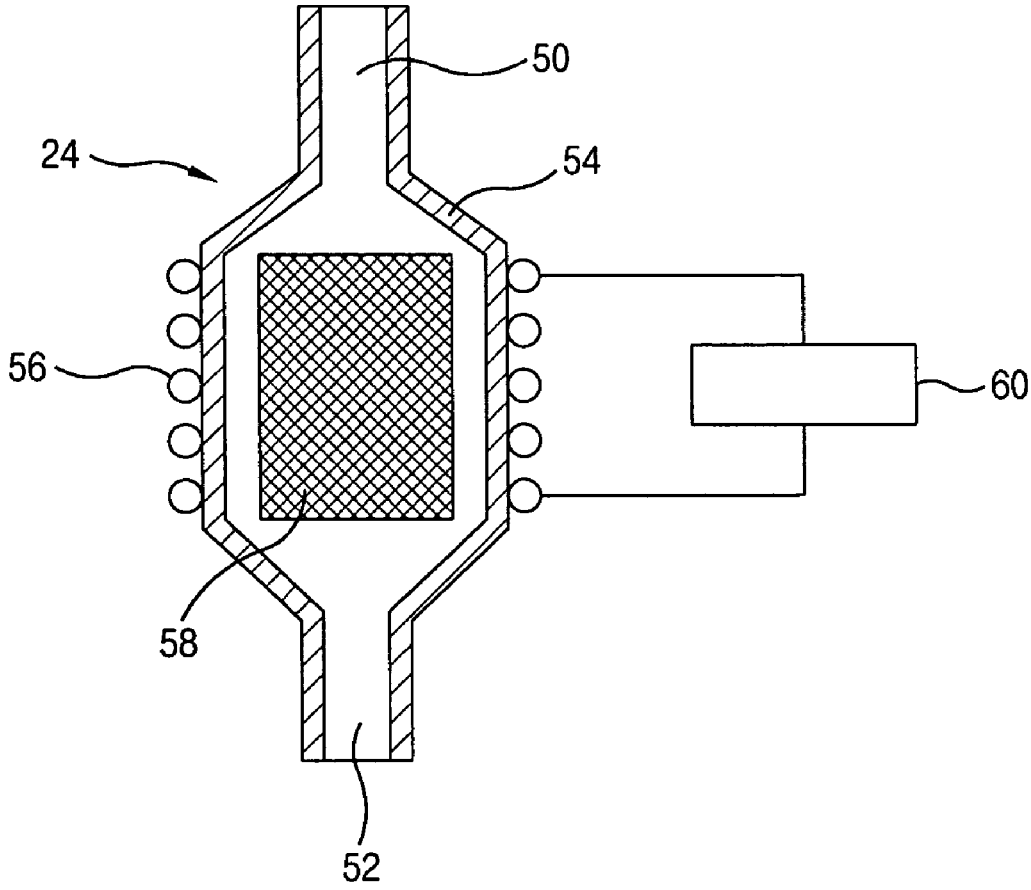
FIG. 3 is a sectional view showing a steam generating apparatus according to the present invention.

FIG. 3 is a sectional view of a steam generating apparatus according to the present invention.

The steam generating apparatus 24 includes a housing 54 having a water supply pipe 50 connected with the water supply line 32, and through which water is supplied, and a steam discharge pipe 52 connected with a steam supply line 34, and through which steam is discharged; a coil 56 disposed at an outer circumferential surface of the housing 54, and through which a high-frequency current flows so that a high-frequency magnetic field is generated; and a heating material 58 disposed at the inside of the housing 54, and which generates heat by the high-frequency magnetic field generated at the coil 56, and thus, heats water supplied into the housing 54 thereby generating steam.

In order to increase pressure of steam discharged at the spray nozzle 26, a fan 70 for sending air to steam is installed at the steam supply line 34 connected with the steam discharge pipe 52 of the housing 54, The coil 56 is wound on an outer circumferential surface of the housing 54 in a longitudinal direction of the housing, and is electrically connected with an inverter 60 applying a high-frequency current.

The steam generating apparatus 24 constructed as above performs heating by the same principle as that of a high-frequency induction heating apparatus which is generally used.

Operations of the washing machine according to the present invention constructed as above will now be described.

First, after putting laundry into the drum 16, when a user presses a steam wash operating button, water flowed to the water supply line 18 passes through the detergent box 20 and is supplied to the inside of the tub 14 together with a detergent. And, the washing machine performs an operation of dissolving the detergent for a certain time. Then, the water supply valve (not shown) is operated, and so the water supply line 32 is opened so that water is supplied into the housing 54 through the water supply pipe 50.

At this time, when power is applied to the inverter 60, the high-frequency current is applied to the coil 56 and thus a high-frequency magnetic field is generated at the coil 56, so that the heating material 58 disposed at the inside of the housing 54 generates heat by an electromagnetic induction. Then, passing through the heating material 58, the water supplied into the housing through the water supply pipe 50 momentarily steams. The steam is discharged to the steam discharge pipe 52 and supplied to the spray nozzle through the dividing unit 30. Then, through the spray nozzle 26, the steam is directly sprayed on laundry stored at the inside of the drum 16.

Then, when the temperature in the tub 14 reaches a certain temperature, the water supply valve is closed thereby preventing water from being supplied to the housing 54, and at the same time, preventing the current from being supplied to the coil 56, so that the operation of the steam generating apparatus 24 is stopped.

In the washing machine according to the present invention constructed and operated as above, steam is sprayed into the drum of the washing machine to heat the laundry, thereby reducing an entire size of the washing machine, reducing the amount of water used for washing, minimizing power consumption, and shortening time for washing.

In addition, the washing machine according to the present invention is provided with a steam generating apparatus using a high-frequency induction heating principle, thereby simplifying a structure of the steam generating apparatus and improving performance of generating steam.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A washing machine comprising:

a cabinet;

a tub disposed inside the cabinet, the tub being configured to store water;

a drum rotatably disposed inside the tub to wash laundry placed therein; and a steam generating apparatus disposed inside the cabinet to generate steam by using high-frequency induction heating, wherein the generated steam is directly supplied to laundry placed into the drum.

2. The washing machine of claim 1, wherein the steam generating apparatus comprises:

a housing having a water supply pipe through which water is supplied, and a steam discharge pipe through which steam is discharged;

a coil disposed at an outer circumferential surface of the housing to generate a high-frequency magnetic field; and a heating material disposed inside the housing to generate heat to generate steam from the supplied water by the high-frequency magnetic field generated from the coil.

3. The washing machine of claim 2, wherein the steam discharge pipe of the housing is connected with a spray nozzle by a steam supply line so that the steam generated from the housing is sprayed into the drum through the spray nozzle.

4. The washing machine of claim 3, wherein a fan is installed at one side of the steam supply line to increase spray pressure of the spray nozzle.

5. The washing machine of claim 2, wherein the coil is wound on the outer circumferential surface of the housing, and the coil is electrically connected with an inverter that applies a high-frequency current.

6. A washing machine comprising:

a cabinet;

a tub disposed inside the cabinet, the tub being configured to store water;

a drum rotatably disposed inside of the tub to wash laundry placed therein;

a steam generating apparatus disposed inside the cabinet to generate steam by using high-frequency induction heating, the generated steam being directly supplied to the laundry placed into the drum;

a water supply tube to supply water into the tub; and a water supply line to supply water into the steam generating apparatus.

7. The washing machine of claim 6, further comprising:

a discharge pipe to discharge water stored in the tub;

a circulation pump to pump the discharged water;

a circulation line to supply the discharged water into the drum; and a steam supply line to supply the generated steam into the drum.

8. The washing machine of claim 7, further comprising:

a divided unit connected with the circulation line and the steam supply line; and a spray nozzle to spray the discharged water and the generated steam into the drum.

9. A laundry machine comprising:

a cabinet;

a drum rotatably disposed inside the cabinet, the drum being configured to receive laundry therein;

a steam generating apparatus disposed inside the cabinet to generate steam by using high-frequency induction heating; and a steam supply line to supply the generated steam into the drum.

10. The laundry machine of claim 9, further comprising a spray nozzle for directly spraying the generated steam to laundry placed into the drum.

* * * * *